US010991305B2

(12) United States Patent
Park et al.

(10) Patent No.: US 10,991,305 B2
(45) Date of Patent: Apr. 27, 2021

(54) ORGANIC LIGHT EMITTING DISPLAY DEVICE AND DRIVING METHOD THEREOF

(71) Applicant: Samsung Display Co., Ltd., Yongin-si (KR)

(72) Inventors: Jun Hyun Park, Yongin-si (KR); Cheol Gon Lee, Yongin-si (KR); Yang Hwa Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 69 days.

(21) Appl. No.: 16/264,199

(22) Filed: Jan. 31, 2019

(65) Prior Publication Data

US 2019/0237020 A1 Aug. 1, 2019

(30) Foreign Application Priority Data

Feb. 1, 2018 (KR) ..... 10-2018-0013050

(51) Int. Cl.
*G09G 3/3258* (2016.01)
*G09G 3/3233* (2016.01)
*G09G 3/3266* (2016.01)

(52) U.S. Cl.
CPC ..... *G09G 3/3258* (2013.01); *G09G 3/3233* (2013.01); *G09G 3/3266* (2013.01); *G09G 2300/0426* (2013.01); *G09G 2300/0819* (2013.01); *G09G 2300/0842* (2013.01); *G09G 2310/08* (2013.01); *G09G 2320/0233* (2013.01); *G09G 2330/021* (2013.01)

(58) Field of Classification Search
CPC ..... G09G 3/3258; G09G 3/3266; G09G 2320/0233; G09G 2300/0842; G09G 2300/0426; G09G 2310/08; G09G 2330/021; G09G 2300/0819; G09G 2300/0866; G09G 3/3233; G09G 2300/0852
See application file for complete search history.

(56) References Cited

U.S. PATENT DOCUMENTS 8,654,158 B2 * 2/2014 Tsai ..... G09G 3/3233 257/59
8,780,102 B2 * 7/2014 Han ..... G09G 3/3233 345/208
9,269,297 B2 * 2/2016 Kanda ..... G09G 3/3233
(Continued)

*Primary Examiner* — Patrick N Edouard
*Assistant Examiner* — Joseph P Fox
(74) *Attorney, Agent, or Firm* — H.C. Park & Associates, PLC

(57) ABSTRACT

An organic light emitting (OLE) display device includes pixels connected to scan lines (SLs), data lines (DLs), and a first control line (FCL) commonly connected to the pixels. Each pixel includes: an OLE diode connected between a first power source (PS) and a second PS; a first transistor (TFT1) connected between the first PS and the OLE diode, a gate electrode (GE) of the TFT1 being connected to a first node (N1); a second transistor (TFT2) connected between the N1 and a second node (N2), a GE of the TFT2 being connected to a SL; a third transistor (TFT3) connected between the N2 and a third node (N3), the N3 being connected between the TFT1 and the OLED, a GE of the TFT3 being connected to the FCL; a first capacitor connected between the first PS and the N1; and a second capacitor connected between the N2 and a DL.

18 Claims, 8 Drawing Sheets

(56) References Cited

U.S. PATENT DOCUMENTS

| | | | | |
|---|---|---|---|---|
| 10,665,166 | B2 * | 5/2020 | Park | G09G 3/3258 |
| 2003/0179221 | A1 * | 9/2003 | Nitta | G09G 3/3406<br>345/690 |
| 2011/0279484 | A1 * | 11/2011 | Han | G09G 3/3233<br>345/690 |
| 2012/0249604 | A1 * | 10/2012 | Kim | G09G 3/3258<br>345/690 |
| 2013/0321364 | A1 * | 12/2013 | Chong | G09G 3/003<br>345/204 |
| 2014/0022227 | A1 * | 1/2014 | Kim | G09G 3/003<br>345/212 |
| 2015/0061537 | A1 * | 3/2015 | Kanda | G09G 3/003<br>315/291 |
| 2015/0356921 | A1 * | 12/2015 | Lee | G09G 3/3233<br>345/699 |
| 2018/0204510 | A1 * | 7/2018 | Chung | G09G 3/3233 |
| 2018/0226023 | A1 * | 8/2018 | Park | G09G 3/3233 |

* cited by examiner

ORGANIC LIGHT EMITTING DISPLAY DEVICE AND DRIVING METHOD THEREOF

CROSS-REFERENCE TO RELATED APPLICATION

This application claims priority from and the benefit of Korean Patent Application No. 10-2018-0013050, filed Feb. 1, 2018, which is hereby incorporated by reference for all purposes as if fully set forth herein.

BACKGROUND

Field

Exemplary embodiments generally relate to display devices, and more specifically, to an organic light emitting display device and a driving method thereof.

Discussion

Generally, an organic light emitting display device includes pixels connected to data lines and scan lines. Each of the pixels may include an organic light emitting diode, a driving transistor for controlling an amount of current flowing to the organic light emitting diode, at least one transistor for compensating a threshold voltage deviation of the driving transistor, and at least one capacitor for storing a data signal. Such a pixel may be driven while compensating a threshold voltage of the driving transistor in units of horizontal lines. However, as the resolution of a display panel increases, respective horizontal periods are shortened, making it difficult to sufficiently compensate the threshold voltage of the driving transistor. Also, as the resolution of a display panel increases, an area of each pixel is reduced.

The above information disclosed in this section is only for understanding the background of the inventive concepts, and, therefore, may contain information that does not form prior art.

SUMMARY

Some exemplary embodiments are capable of providing an organic light emitting display device and a driving method thereof applicable to a high-resolution display panel.

Additional aspects will be set forth in the detailed description which follows, and, in part, will be apparent from the disclosure, or may be learned by practice of the inventive concepts.

According to some exemplary embodiments, an organic light emitting display device includes pixels connected to scan lines, data lines, and a first control line. The organic light emitting display device is configured to drive the pixels in a frame period, which at least includes a first period, a second period, a third period, and a fourth period. Each of the pixels includes: an organic light emitting diode connected between a first power source and a second power source; a first transistor connected between the first power source and the organic light emitting diode, a gate electrode of the first transistor being connected to a first node; a second transistor connected between the first node and a second node, a gate electrode of the second transistor being connected to a corresponding scan line among the scan lines; a third transistor connected between the second node and a third node, the third node being connected between the first transistor and the organic light emitting diode, a gate electrode of the third transistor being connected to the first control line; a first capacitor connected between the first power source and the first node; and a second capacitor connected between the second node and a corresponding data line among the data lines. The pixels are commonly connected to the first control line.

In some exemplary embodiments, the pixels may be simultaneously driven during the first period, the second period, and the fourth period, and the pixels may be sequentially driven in units of horizontal lines during the third period.

In some exemplary embodiments, the organic light emitting display device may further include: a scan driver configured to supply scan signals to the scan lines; a data driver configured to supply data signals to the data lines; a first power source driver configured to supply the first power source to the pixels; a second power source driver configured to supply the second power source to the pixels; and a timing controller configured to control the scan driver, the data driver, the first power source driver, and the second power source driver, the timing controller being configured to supply a first control signal to the first control line.

In some exemplary embodiments, the first power source driver may be configured to supply the first power source of a first voltage less than or equal to a voltage of the second power source to the pixels during the first period, and the first power source driver may be configured to supply the first power source of a second voltage greater than or equal to the voltage of the second power source to the pixels during the second period, the third period, and the fourth period.

In some exemplary embodiments, the timing controller may be configured to supply the first control signal of a gate-on voltage to the first control line from a determined time in the first period to a determined time in the second period.

In some exemplary embodiments, the scan driver may be configured to simultaneously supply scan signals of a gate-on voltage to the scan lines from a determined time in the first period to a determined time in the second period, and the scan driver may be configured to sequentially supply the scan signals of the gate-on voltage to the scan lines during the third period.

In some exemplary embodiments, during the first period and the second period, the scan driver may be configured to: start a supply of the scan signals after starting a supply of the first control signal; and stop the supply of the scan signals after stopping the supply of the first control signal.

In some exemplary embodiments, the frame period may include: a first duration from a determined time in the first period in which the scan signals and the first control signal are supplied through the third period, and a second duration corresponding to a remaining portion of the frame period other than the first duration. The second power source driver may be configured to supply the second power source of a third voltage greater than or equal to a voltage of the first power source during the first duration of the frame period, and the second power source driver may be configured to supply the second power source of a fourth voltage less than or equal to the voltage of the first power source during the second duration of the frame period.

In some exemplary embodiments, the frame period may further include a black current prevention period between the third period and the fourth period.

In some exemplary embodiments, the first power source driver may be configured to supply the first power source of a first voltage less than or equal to a voltage of the second power source during the first period and the black current prevention period, and the first power source driver may be configured to supply the first power source of a second voltage greater than or equal to the voltage of the second power source during the second period, the third period, and the fourth period.

In some exemplary embodiments, the organic light emitting display device may further include a second control line commonly connected to the pixels. Each of the pixels may further include a fourth transistor connected between the first power source and the third node, and a gate electrode of the fourth transistor may be connected to the second control line.

In some exemplary embodiments, the first power source driver may be configured to supply the first power source of a first voltage less than or equal to a voltage of the second power source during the first period, and the organic light emitting display device may be configured to supply a second control signal of a gate-on voltage to the second control line during the first period.

In some exemplary embodiments, the first power source driver may be configured to supply the first power source of a second voltage greater than or equal to the voltage of the second power source during the second period, the third period, and the fourth period, and the organic light emitting display device may be configured to maintain a voltage of the second control line at a gate-off voltage during the second period, the third period, and the fourth period.

In some exemplary embodiments, the frame period may further include a black current prevention period between the third period and the fourth period.

In some exemplary embodiments, the first power source driver may be configured to supply the first power source of the first voltage during the black current prevention period, and the organic light emitting display device may be configured to supply the second control signal of the gate-on voltage to the second control line during the black current prevention period.

In some exemplary embodiments, the second power source driver may be configured to supply the second power source of a third voltage greater than or equal to a voltage of the first power source during the second period and the third period, and the second power source driver may be configured to supply the second power source of a fourth voltage less than or equal to the voltage of the first power source during at least a portion of the fourth period.

According to some exemplary embodiments, a method of driving an organic light emitting display device during a frame period, the organic light emitting display device including pixels, the frame period including a first period, a second period, a third period, and a fourth period, the method including: initializing an anode voltage of each organic light emitting diode of the pixels to a first voltage while supplying a first power source of the first voltage to the pixels during the first period; initializing first nodes to the first voltage during at least a portion of the first period, the first nodes being respectively connected to gate electrodes of corresponding driving transistors of the pixels; storing voltages corresponding to threshold voltages of the driving transistors in respective first capacitors of the pixels while supplying the first power source of a second voltage greater than the first voltage during the second period; storing one or more voltages corresponding to a data signal in the respective first capacitors of the pixels while sequentially supplying scan signals to scan lines connected to the pixels during the third period; and allowing the pixels to emit light corresponding to the data signal during the fourth period.

In some exemplary embodiments, the pixels may be simultaneously driven during the first period, the second period, and the fourth period, and the pixels may be sequentially driven in units of horizontal lines during the third period.

In some exemplary embodiments, a second power source of a third voltage greater than or equal to a voltage of the first power source may be supplied to the pixels at least during the second period and the third period, and the second power source of a fourth voltage less than or equal to the voltage of the first power source may be supplied to the pixels during at least a portion of the fourth period.

In some exemplary embodiments, the frame period may further include a black current prevention period between the third period and the fourth period, and the method may further include initializing an anode voltage of each organic light emitting diode of the pixels to the first voltage while simultaneously supplying the first power source of the first voltage to the pixels during the black current prevention period.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION OF THE ILLUSTRATED EMBODIMENTS

Figure 1:
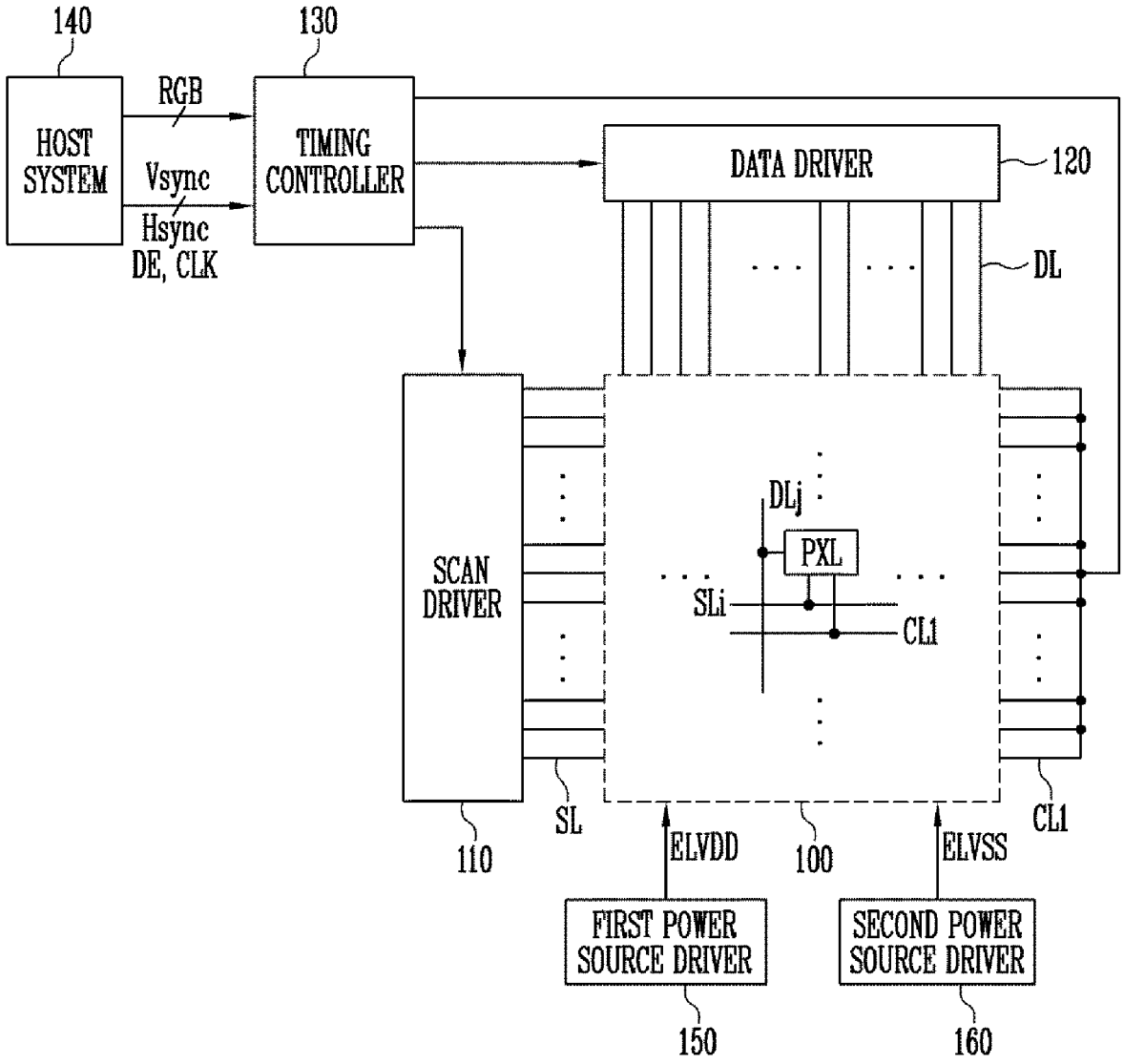
FIG. 1 is a diagram illustrating an organic light emitting display device according to some exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some exemplary embodiments. Therefore, unless otherwise specified, the features, components, modules, layers, films, panels, regions, aspects, etc. (hereinafter individually or collectively referred to as an "element" or "elements"), of the various illustrations may be otherwise combined, separated, interchanged, and/or rearranged without departing from the inventive concepts.

in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. Other terms and/or phrases used to describe a relationship between elements should be interpreted in a like fashion, e.g., "between" versus "directly between," "adjacent" versus "directly adjacent," "on" versus "directly on," etc. Further, the term "connected" may refer to physical, electrical, and/or fluid connection. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one element's relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the inventive concepts. Further, the blocks, units, and/or modules of some exemplary embodiments may be physically combined into more complex blocks, units, and/or modules without departing from the inventive concepts.

FIG. 1 is a diagram illustrating an organic light emitting display device according to some exemplary embodiments.

Referring to FIG. 1, an organic light emitting display device according to an some exemplary embodiments includes a pixel unit 100, a scan driver 110, a data driver 120, a timing controller 130, a host system 140, a first power source driver 150, and a second power source driver 160.

Figure 3:
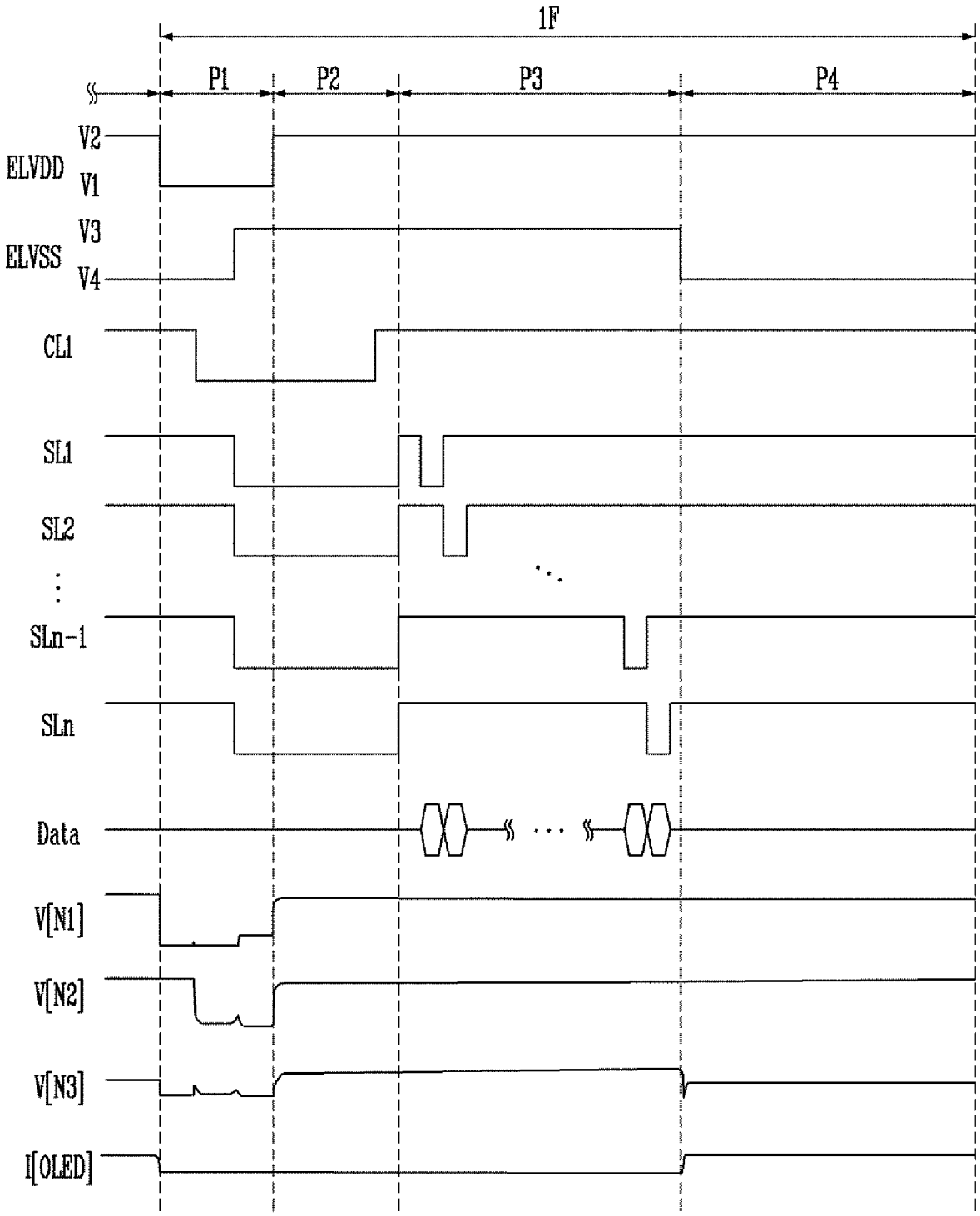
FIG. 3 is a diagram illustrating a driving method of the pixel shown in FIG. 2 according to some exemplary embodiments.

According to some exemplary embodiments, each frame period for driving the organic light emitting display device is divided into a plurality of sub periods. For example, as shown in FIG. 3, one frame period 1F may be divided into at least a first period P1, a second period P2, a third period P3, and a fourth period P4 when the organic light emitting display device is driven. In some exemplary embodiments, all pixels PXL may be simultaneously driven during the first period P1, the second period P2, and the fourth period P4, and the pixels PXL may be sequentially driven in units of horizontal lines during the third period P3.

The pixel unit 100 includes scan lines SL, data lines DL, a first control line CL1, and the plurality of pixels PXL connected to the scan lines SL, the data lines DL, and the first control line CL1.

The scan lines SL are arranged to extend along a first direction, e.g., a horizontal direction, for each horizontal line of the pixel unit 100. Each of the scan lines SL is connected to the pixels PXL disposed in a corresponding horizontal line.

The data lines DL are arranged to extend along a second direction, e.g., a vertical direction, for each vertical line of the pixel unit 100. Each of the data lines DL is connected to the pixels PXL disposed in a corresponding vertical line.

The arrangement directions of the scan lines SL and the data lines DL may be changed. For example, in some exemplary embodiments, the arrangement directions of the scan lines SL and the data lines DL may be reversed with each other.

The first control line CL1 is commonly connected to all the pixels PXL arranged in the pixel unit 100. For example, the first control line CL1 may be branched into a plurality of sub-lines in the pixel unit 100 so that the first control line CL1 is connected to the pixels PXL of the respective horizontal lines, and all the sub-lines may be connected to each other as one. Therefore, the pixels PXL may be simultaneously controlled by using a first control signal supplied from the first control line CL1.

Each pixel PXL is driven by driving signals supplied from the corresponding scan line SL, the corresponding data line DL, and the first control line CL1. For example, the pixel PXL located at an i-th (i is a natural number) horizontal line and a j-th (j is a natural number) vertical line is driven by a scan signal, a data signal, and the first control signal respectively supplied from an i-th scan line SLi, a j-th data line DLj, and the first control line CL1. The pixel PXL emits light at a luminance corresponding to the data signal for each frame period. On the other hand, the pixel PXL supplied with the data signal corresponding to a black grayscale may be controlled not to emit light during the corresponding frame period.

The scan driver 110 supplies scan signals to the scan lines SL. For example, the scan driver 110 may simultaneously supply the scan signals to all the scan lines SL during the first period P1 and the second period P2, and may sequentially supply the scan signals to the scan lines SL during the third period P3. When the scan signals are supplied to the scan lines SL, transistors included in each of the pixels PXL are turned on. To this end, the scan signals are set to a gate-on voltage (e.g., a low voltage) that allows the transistors included in each of the pixels PXL to be turned on.

The data driver 120 generates data signals using image data (for example, image data RGB rearranged in the timing controller 130) input from the timing controller 130. The data signals generated in the data driver 120 are supplied to the data lines DL so as to be synchronized with the scan signals sequentially supplied to the scan lines SL during the third period P3.

The timing controller 130 controls the driving units (e.g., the scan driver 110, the data driver 120, the first power source driver 150, and the second power source driver 160) based on timing signals such as a vertical synchronization signal Vsync, a horizontal synchronization signal Hsync, a data enable signal DE, and a clock signal CLK, and the image data RGB output from the host system 140. In addition, the timing controller 130 supplies the first control signal to the first control line CL1 based on the timing signals. In one example, the timing controller 130 may supply the first control signal during at least one period of each of the first period P1 and the second period P2, respectively. The first control signal is set to a gate-on voltage (for example, a low voltage) that allows the transistors included in each of the pixels PXL to be turned on.

The host system 140 supplies the image data RGB to the timing controller 130 through an interface. Also, the host system 140 supplies the timing signals, e.g., the vertical synchronization signal Vsync, the horizontal synchronization signal Hsync, the data enable signal DE, and the clock signal CLK, to the timing controller 130.

The first power source driver 150 supplies a first power source ELVDD to the pixels PXL. According to some exemplary embodiments, the first power source driver 150 may change a voltage level of the first power source ELVDD at a predetermined time in one frame period 1F. For example, the first power source driver 150 may supply the first power source ELVDD of a first voltage V1 to the pixels PXL during the first period P1, and may supply the first power source ELVDD of a second voltage V2 higher than the first voltage V1 to the pixels PXL during the second period P2, the third period P3, and the fourth period P4, under the control of the timing controller 130. The first voltage V1 may be set equal to or lower than a voltage of a second power source ELVSS, and the second voltage V2 may be set equal to or higher than the voltage of the second power source ELVSS. For example, the first voltage V1 may be set to a voltage at which the pixels PXL may not emit light, and the second voltage V2 may be set to a voltage at which the pixels PXL may emit light.

The second power source driver 160 supplies the second power source ELVSS to the pixels PXL. According to some exemplary embodiments, the second power source driver 160 may change a voltage level of the second power source ELVSS at a predetermined time in one frame period 1F. For example, the second power source driver 160 may supply the second power source ELVSS of a third voltage V3 to the pixels PXL at least during the second period P2 and the third period P3, and may supply the second power source ELVSS of a fourth voltage V4 lower than the third voltage V3 to the pixels PXL during the remaining period. For example, the third voltage V3 may be set higher than the second voltage V2 so that the pixels PXL are set to a non-light emitting state, and the fourth voltage V4 may be set lower than the second voltage V2 so that the pixels PXL are set to a light emitting state.

Figure 2:
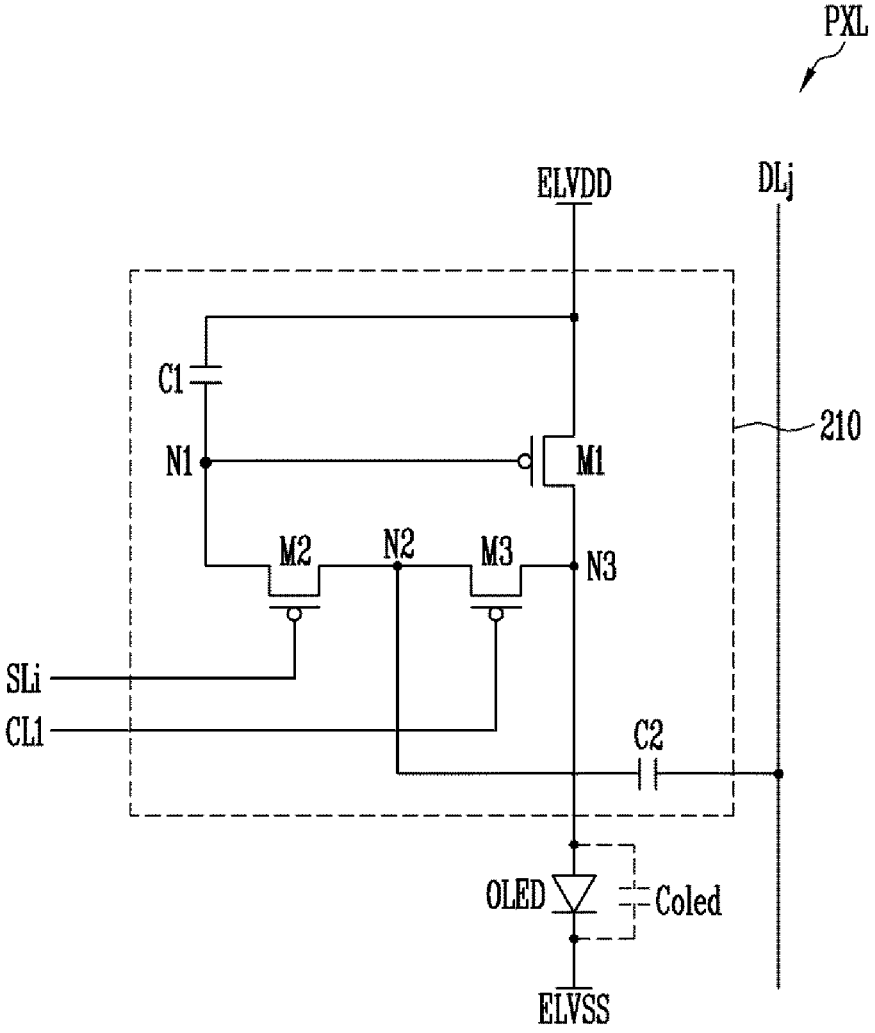
FIG. 2 is a diagram illustrating a pixel of the organic light emitting display device shown in FIG. 1 according to some exemplary embodiments.

FIG. 2 is a diagram illustrating a pixel of the organic light emitting display device shown in FIG. 1 according to some exemplary embodiments. For convenience, FIG. 2 shows the pixel PXL connected to the i-th horizontal line and the j-th vertical line. According to some exemplary embodiments, all the pixels PXL included in the pixel unit 100 may have substantially the same structure as the pixel PXL of FIG. 2.

Referring to FIG. 2, the pixel PXL according to some exemplary embodiments includes an organic light emitting diode OLED and a pixel circuit 210 for controlling an amount of the current supplied to the organic light emitting diode OLED.

The organic light emitting diode OLED is connected between the first power source ELVDD and the second power source ELVSS. For example, an anode electrode of the organic light emitting diode OLED may be connected to the first power source ELVDD via the pixel circuit 210, and a cathode electrode of the organic light emitting diode OLED may be connected to the second power source ELVSS. The organic light emitting diode OLED emits light at a luminance corresponding to the amount of the current supplied from the pixel circuit 210.

The pixel circuit 210 controls the amount of the current supplied to the organic light emitting diode OLED in response to the data signal. To this end, the pixel circuit 210 includes a first transistor M1, a second transistor M2, a third transistor M3, a first capacitor C1, and a second capacitor C2.

The first transistor M1 is connected between the first power source ELVDD and the organic light emitting diode OLED. For example, the first transistor M1 may be connected between the first power source ELVDD and the third node N3. The third node N3 refers to a connection node between the first transistor M1 and the anode electrode of the organic light emitting diode OLED. A gate electrode of the first transistor M1 is connected to the first node N1. The first transistor M1 controls an amount of the current supplied from the first power source ELVDD to the second power source ELVSS via the organic light emitting diode OLED in response to a voltage of the first node N1. That is, the first transistor M1 may be a driving transistor of the pixel PXL.

The second transistor M2 is connected between the first node N1 and the second node N2. The second node N2 refers to a connection node between the second transistor M2 and the third transistor M3. A gate electrode of the second transistor M2 is connected to the corresponding scan line, i.e., the i-th scan line SLi. When a scan signal is supplied to the i-th scan line SLi, the second transistor M2 is turned on to electrically connect the first node N1 and the second node N2.

The third transistor M3 is connected between the second node N2 and the third node N3. A gate electrode of the third transistor M3 is connected to the first control line CL1. When the first control signal is supplied to the first control line CL1, the third transistor M3 is turned on to electrically connect the second node N2 and the third node N3.

In some exemplary embodiments, the first, second, and third transistors M1, M2, and M3 may all be formed of a P-type transistor (for example, PMOS); however, exemplary embodiments are not limited thereto. For example, in some exemplary embodiments, at least one of the first, the second, and the third transistors M1, M2, and M3 may be formed of an N-type transistor (e.g., NMOS).

The first capacitor C1 is connected between the first power source ELVDD and the first node N1. The first capacitor C1 charges a voltage corresponding to the data signal and a threshold voltage of the first transistor M1.

The second capacitor C2 is connected between the corresponding data line, that is, the j-th data line DLj, and the second node N2. The second capacitor C2 controls a voltage of the second node N2 in response to a voltage of the data signal supplied to the data line DLj.

FIG. 3 is a diagram illustrating a driving method of the pixel shown in FIG. 2 according to some exemplary embodiments. Hereinafter, the embodiment of the driving method of the pixels PXL will be described in detail with reference to FIGS. 1 to 3.

Referring to FIG. 3, one frame period 1F may be divided into the first period P1, the second period P2, the third period P3, and the fourth period P4 that are sequentially arranged when the pixels PXL are driven. The first period P1, the second period P2, the third period P3, and the fourth period P4 may be set as an initialization period, a compensation period, a data writing period, and a light emitting period, respectively.

The first power source driver 150 simultaneously supplies the first power source ELVDD of the first voltage V1 (e.g., the low voltage) to the pixels PXL during the first period P1. In addition, the first power source driver 150 simultaneously supplies the first power source ELVDD of the second voltage V2 to the pixels PXL during the second period P2, the third period P3, and the fourth period P4.

The second power source driver 160 simultaneously supplies the second power source ELVSS of the third voltage V3 (e.g., the high voltage) to the pixels PXL at least during the second period P2 and the third period P3. For example, the second power source driver 160 may simultaneously supply the second power source ELVSS of the third voltage V3 to the pixels PXL during the second period P2 and the third period P3 from a period in which the first control signal and the scan signal of the gate-on voltage are supplied during the first period P1. In addition, the second power driver 160 simultaneously supplies the second power source ELVSS of the fourth voltage V4 (e.g., the low voltage) to the pixels PXL during the remaining period of one frame period 1F.

The timing controller 130 supplies the first control signal of the gate-on voltage to the first control line CL1 from a predetermined time (for example, the time after the third node N3 is initialized to the low voltage) of the first period P1 to a predetermined period of the second period P2. Also, the timing controller 130 does not supply the first control signal during the remaining period of one frame period 1F. That is, the voltage of the first control line CL1 may be set to a gate-off voltage (e.g., the high voltage) during the remaining period.

The scan driver 110 simultaneously supplies the scan signals of the gate-on voltage to scan lines SL1 to SLn from a predetermined time in the first period P1 to a predetermined time in the second period P2. For example, the scan driver 110 may start a supply of the scan signals at a time after starting a supply of the first control signal during the first period P1, and may stop the supply of the scan signals at a time after stopping the supply of the first control signal during the second period P2.

In addition, the scan driver 110 sequentially supplies the scan signals of the gate-on voltage to the scan lines SL1 to SLn during the third period P3. During the third period P3, the data driver 120 may supply the corresponding data signals Data to the pixels PXL of each horizontal line via the data lines DL in synchronization with the scan signals sequentially supplied to the scan lines SL1 to SLn.

The scan driver 110 may not supply the scan signals during the remaining period of one frame period 1F. That is, voltages of the scan lines SL1 to SLn may be set to the gate-off voltage (e.g., the high voltage) during the remaining period.

Hereinafter, the operation processes of the pixels PXL during one frame period 1F will be sequentially described with reference to the pixel PXL shown in FIG. 2 as an example. In FIG. 3, "V[N1]" refers to the voltage of the first node N1, "V[N2]" refers to the voltage of the second node N2, and "V[N3]" refers to the voltage of the third node N3 (i.e., the anode voltage of the organic light emitting diode OLED). Additionally, "I[OLED]" refers to a current flowing in the organic light emitting diode OLED. However, the magnitude of the current I[OLED] may vary depending on the voltage (e.g., grayscale) of the data signal Data. In addition, the voltages V[N1] and V[N2] of the first and second nodes N1 and N2 during the third and fourth periods P3 and P4 may vary depending on the voltage of the data signal Data. For convenience, in FIG. 3, the voltages V[N1] and V[N2] of the first and second nodes N1 and N2 in the third and fourth periods P3 and P4 are arbitrarily shown.

Firstly, the first power source ELVDD of the first voltage V1 (e.g., the low voltage) is supplied to each pixel PXL during the first period P1. The voltage of the first node N1 also falls due to the coupling of the first capacitor C1. Also, as the voltage of the first node N1 falls, the first transistor M1 is turned on. The first voltage V1 may be set so that the first transistor M1 can be turned on regardless of the voltage of the first node N1 applied in the previous frame period.

When the first transistor M1 is turned on, the voltage of the third node N3 (e.g., the anode voltage of the organic light emitting diode OLED) is initialized by the first voltage V1 of the first power source ELVDD. For example, during the first period P1, the voltage of the third node N3 may be initialized to approximately the first voltage V1. According to some exemplary embodiments, the first voltage V1 may be set to a low voltage (e.g., the fourth voltage V4) of the second power source ELVSS so that the pixels PXL may be initialized to the first voltage V1 during the first period P1.

The scan signal and the first control signal of the gate-on voltage are respectively supplied to the scan line SLi and the first control line CL1 at a predetermined time after the third node N3 is initialized during the first period P1. According to some exemplary embodiments, the first control signal and the scan signal are simultaneously supplied to all the pixels PXL, and the first control signal and the scan signal may be sequentially supplied. For example, after the supply of the first control signal in the first period P1 is started, the supply of the scan signal may be started. When the supplies of the first control signal and the scan signal are sequentially started in this way, voltage instability of the first node N1 due to kickback voltage generated in response to the second and third transistors M2 and M3 being turned on/off may be prevented or reduced. However, exemplary embodiments are not limited thereto. For example, in some exemplary embodiments, the supply of the first control signal and the scan signal may be simultaneously started at a predetermined time in the first period P1.

For example, when the first control signal is supplied to the first control line CL1, the third transistor M3 is turned on. When the third transistor M3 is turned on, the second node N2 and the third node N3 are electrically connected. Thus, the voltage of the second node N2 is initialized. For example, the voltage of the second node N2 may be initialized to the voltage of the third node N3, that is, approximately the first voltage V1.

When the scan signal is supplied to the scan line SLi with the first control signal being supplied thereto, the second transistor M2 is turned on. When the second transistor M2 is turned on, the first node N1 and the second node N2 are electrically connected. Accordingly, charge sharing occurs while the first node N1, the second node N2, and the third node N3 are all electrically connected. As such, the voltage of the first node N1 is also initialized. For example, the voltage of the first node N1 may be initialized to the voltages of the second and third nodes N2 and N3, that is, approximately the first voltage V1. Also, as the second and third transistors M2 and M3 are both turned on, the first transistor M1 is diode-connected.

That is, the voltages of the third node N3, the second node N2, and the first node N1 are sequentially initialized during the first period P1. For example, the third node N3, the second node N2, and the first node N1 may be initialized to substantially the same voltage, e.g., the first voltage V1. When the voltage of the third node N3 is initialized, the anode voltage of the organic light emitting diode OLED is initialized. When the voltage of the first node N1 is initialized, the voltage of the first capacitor C1 is initialized.

In addition, the voltage of the second power source ELVSS rises from the fourth voltage V4 to the third voltage V3 at a predetermined time in the first period P1. For example, the voltage of the second power source ELVSS may rise to the third voltage V3 at a time when the supply of the scan signal is started during the first period P1. When the voltage of the second power source ELVSS rises to the third voltage V3 in this manner, current is prevented from being supplied to the organic light emitting diode OLED during the subsequent second and third periods P2 and P3. Therefore, it is possible to prevent the organic light emitting diode OLED from unintentionally emitting light. Therefore, unintended light emission of the organic light emitting diode OLED may be prevented. When the voltage of the second power source ELVSS is raised while the first power source ELVDD maintains the first voltage V1 as previously described, the voltage of the third node N3 is prevented from being raised due to an organic capacitor Coled.

The first power source ELVDD of the second voltage V2 (e.g., the high voltage) higher than the first voltage V1 is supplied to the pixel PXL during the second period P2 following the first period P1. As a result, the voltage of the first node N1 rises to the high voltage. On the other hand, the supply of the first control signal and the scan signal to the pixel PXL are maintained for at least one period including an initial period (or portion) of the second period P2. Accordingly, the second and third transistors M2 and M3 remain turned on during the at least one period (or portion) of the second period P2, and the first transistor M1 is maintained in a diode-connected state. Accordingly, a voltage corresponding to the threshold voltage of the first transistor M1 is applied to the first node N1, and the voltage corresponding to the threshold voltage of the first transistor M1 is stored in the first capacitor C1. Since the threshold voltage of the first transistor M1 is stored in the state where the first power source ELVDD is set to the second voltage V2 during the second period P2, the voltage of the first capacitor C1 is prevented from being additionally fluctuated. Accordingly, the initialization of the first capacitor C1 and the threshold voltage compensation of the first transistor M1 can be stably performed during the first and second periods P1 and P2.

Supply of the first control signal and the scan signal are sequentially stopped at a time after the threshold voltage of the first transistor M1 is sufficiently stored in the first capacitor C1. When the supply of the first control signal is stopped, the third transistor M3 is turned off due to the voltage of the first control line CL1 rising to the gate-off voltage (e.g., the high voltage). When the supply of the scan signal is stopped, the second transistor M2 is turned off due to the voltage of the scan line SLi rising to the gate-off voltage (e.g., a high voltage). In this manner, the first node N1 is brought into a floating state. Although the supply of the first control signal and the scan signal are sequentially stopped as previously described, exemplary embodiments are not limited thereto. For example, in some exemplary embodiments, the supply of the first control signal and the scan signal are stopped in the reverse order, or the second period P2 may be terminated while the supply of the first control signal and the scan signal are stopped at the same time.

During the first period P1 to the second period P2 as described above, all the pixels PXL are simultaneously driven. The voltage corresponding to the threshold voltage of the first transistor M1 is stored in the first capacitor C1 included in each of the pixels PXL by the first period P1 to the second period P2.

During the third period P3 following the second period P2, the scan signals are sequentially supplied to the scan lines SL1 to SLn. When the scan signal is supplied to the i-th scan line SLi, the second transistor M2 of each of the pixels PXL arranged on the i-th horizontal line is turned on.

The data signals Data are supplied to the data lines DL so as to be synchronized with the scan signal supplied to the i-th scan line SLi. For example, the data signal Data of the pixel PXL may be supplied to the data line DLj of the pixel PXL located at the j-th vertical line during the i-th horizontal period in which the i-th horizontal line is selected. When the data signal Data is supplied to the data line DLj, the voltage of the second node N2 is changed due to the coupling of the second capacitor C2. In addition, since the second transistor M2 is turned on by the scan signal, the voltage of the first node N1 is also changed to a voltage corresponding to the data signal Data. Accordingly, the voltage corresponding to the data signal Data is further stored in the first capacitor C1. That is, during the third period P3, the pixels PXL are sequentially driven in units of horizontal lines. The voltage corresponding to the data signal Data of the corresponding frame and the threshold voltage of the first transistor M1 are stored in the first capacitor C1 of each of the pixels PXL during the third period P3.

The second power source ELVSS of the fourth voltage V4 (e.g., the low voltage) supplied to the pixels PXL during the fourth period P4 following the third period P3. On the other hand, the first power source ELVDD maintains the second voltage V2 (e.g., the high voltage) during the fourth period P4. The second voltage V2 and the fourth voltage V4 are set so that a current may flow through the organic light emitting diode OLED. According to some exemplary embodiments, all the pixels PXL may be simultaneously driven during the fourth period P4.

During the fourth period P4, the first transistor M1 supplies a current corresponding to the voltage of the first node N1 to the organic light emitting diode OLED, and accordingly, the organic light emitting diode OLED emits light at a luminance corresponding to the data signal Data. On the other hand, when the voltage of the data signal Data corresponding to a black grayscale is stored in the first capacitor C1, the first transistor M1 maintains a turned-off state, and accordingly, the organic light emitting diode OLED does not emit light.

With continued reference to FIGS. 2 and 3, after the anode voltage of the organic light emitting diode OLED and the voltage of the first capacitor C1 are initialized during the first period P1, the threshold voltage of the transistor M1 is stored in the first capacitor C1 during the second period P2. Then, after the voltage of the data signal Data is stored in the first capacitor C1 during the third period P3 following the second period P2, the current corresponding to the data signal Data flows to the organic light emitting diode OLED during the fourth period P4. Accordingly, regardless of the threshold voltage deviation of the first transistor M1 included in each of the pixels PXL, during the fourth period P4, each of the pixels PXL uniformly emits light at a luminance corresponding to the data signal Data.

The pixels PXL are simultaneously driven during the first period P1, the second period P2, and the fourth period P4, e.g., except for the third period P3, so that an enough time may be assigned for the initialization of the pixels PXL and the compensation of the threshold voltage of the first transistor M1. Thus, the threshold voltage of the first transistor M1 may be stably compensated, and thus, exemplary embodiments are capable of being applied to a high-resolution display panel.

In addition, as described in association with FIGS. 2 and 3, the first capacitor C1 is connected between the first power source ELVDD and the first node N1. Therefore, the first capacitor C1 charges a voltage corresponding to the voltage difference between the first power source ELVDD and the first node N1 during the second and third periods P2 and P3, and maintains the charged voltage during the fourth period P4. Therefore, even if a voltage deviation of the first power source ELVDD supplied to the pixels PXL occurs due to IR drop (e.g., voltage drop across a conductor as a result of electrical resistance of the conductor) of the first power source ELVDD in the pixel unit 100, the voltage deviation of the first power source ELVDD is canceled inside the pixels PXL. That is, during the fourth period P4, the current corresponding to the data signal flows through the pixels PXL irrespective of the voltage drop amount of the first power source ELVDD.

Additionally, the voltage of the second power source ELVSS is maintained at the third voltage V3 during the second and third periods P2 and P3 in order to prevent the light emission of the pixels PXL. Accordingly, after the threshold voltage of the first transistor M1 is stored in the first capacitor C1 during the second period P2 when the first node N1 is floated by stopping the supply of the first control signal and the scan signal, the voltage of the first power source ELVDD may be consistently maintained at the second voltage V2 until the light emission period (e.g., the fourth period P4). Thus, the voltage of the first node N1 may be stabilized.

That is, according to various exemplary embodiments, it is possible to display an image having a uniform luminance irrespective of the threshold voltage of the first transistor M1 and the voltage drop of the first power source ELVDD. In addition, it is possible to improve a driving instability of the pixels PXL due to cross-talk that may occur in adjacent signal lines and/or power source lines. Thus, image quality of the organic light emitting display device can be improved.

In addition, according to various exemplary embodiments, by applying the voltage varying method of the first power source ELVDD and the second power source ELVSS, the threshold voltage of the first transistor M1 may be effectively compensated by only a small number of transistors (for example, the first to third transistors M1 to M3) and the capacitors (e.g., the first and second capacitors C1 and C2). It is also possible to easily control the operation of the pixel PXL with only a small number of control lines (for example, the corresponding scan line SLi and the first control line CL1). Further, it is possible to effectively initialize the pixels PXL without using an additional power source and/or signals. For example, each pixel PXL may be initialized by the first voltage V1 of the first power source ELVDD during the first period P1. Accordingly, the design structure (e.g., layout) of each pixel PXL and the pixel unit 100 may be simplified, and thus, may be applicable to a high-resolution panel.

Also, in various exemplary embodiments, the pixels PXL are initialized using the first power source ELVDD that is formed to have a relatively low resistance as compared with the control lines, such as the scan lines SL1 to SLn and the first control line CL1. For instance, a power source line for supplying the first power source ELVDD is a line through which a current flows when the pixels PXL emit light, and may be formed of a material having a low resistivity in order to prevent (or at least reduce) image quality deterioration due to voltage drop (e.g., IR drop). In one example, the first power source ELVDD may be formed of a source drain metal that is selected with priority given to low inherent resistivity. That is, the power source line for supplying the first power source ELVDD may be composed of materials having a resistance lower than that of a gate metal used for forming the control lines, such as the scan lines SL1 to SLn and/or the first control line CL1. Therefore, when the pixels PXL are initialized using the first power source ELVDD, it is possible to prevent (or at least reduce) the deterioration of the image quality in the form of a smudge due to luminance deviation between the pixels PXL, and ensure a uniform image quality.

Figure 4:
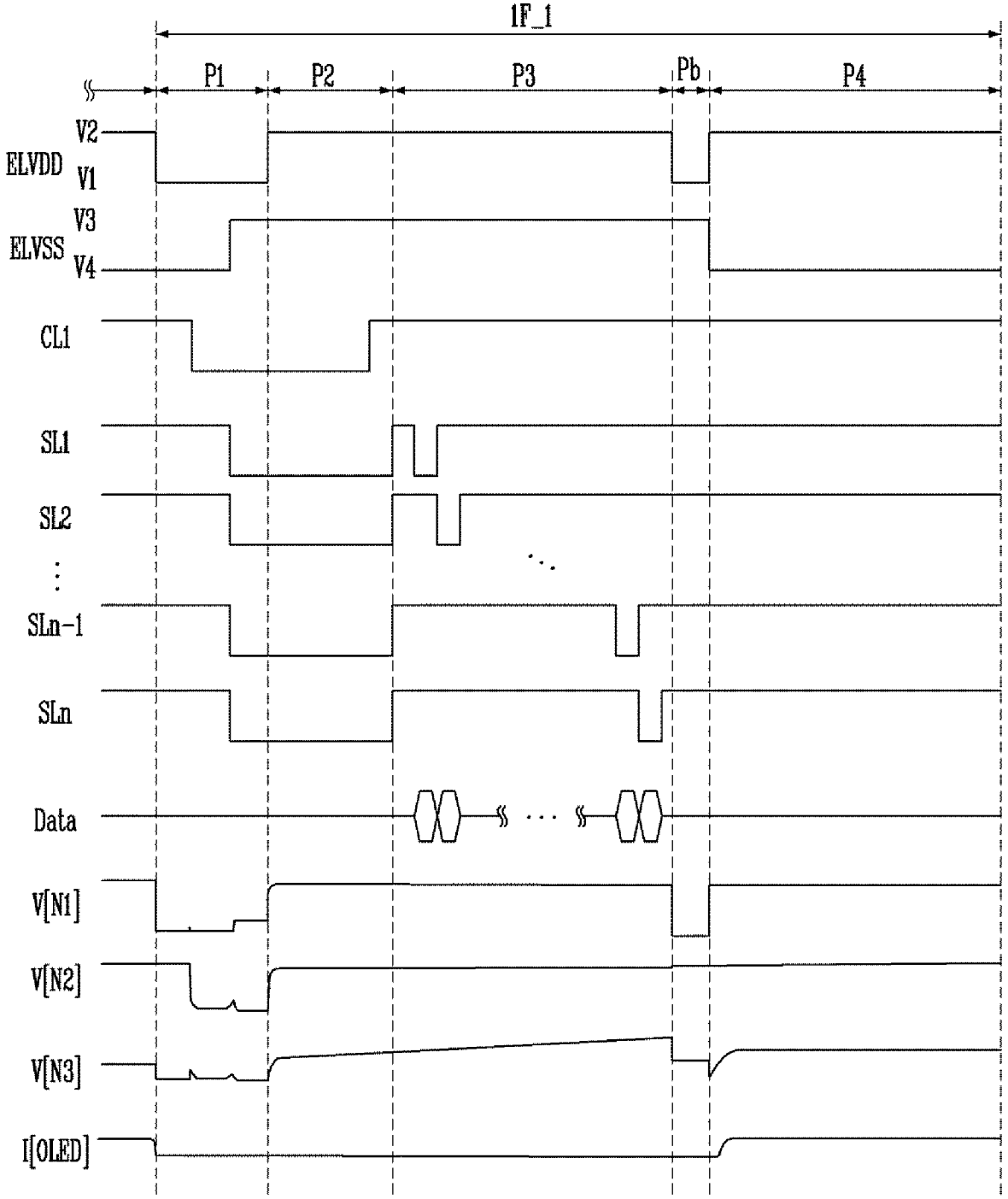
FIG. 4 is a diagram illustrating a driving method of the pixel shown in FIG. 2 according to some exemplary embodiments.

FIG. 4 is a diagram illustrating a driving method of the pixel shown in FIG. 2 according to some exemplary embodiments. In FIG. 4, a detailed description of operations similar or the same as those in FIG. 3 will be omitted.

Referring to FIG. 4, one frame period 1F_1 further includes a black current prevention period Pb (or a black current bypass period) disposed between the third period P3 and the fourth period P4. That is, the black current prevention period Pb may be executed after the data signal Data is stored in the pixels PXL and before the light emission of the pixels PXL.

During the black current prevention period Pb, the first power source driver 150 may simultaneously supply the first power source ELVDD of the first voltage V1 to the pixels PXL. For example, the first power source driver 150 may supply the first power source ELVDD of the first voltage V1 set equal to or lower than the voltage of the second power source ELVSS to the pixels PXL during the first period P1 and the black current prevention period Pb in one frame period 1F_1. The first power source driver 150 may supply the first power source ELVDD of the second voltage V2 set equal to or higher than the voltage of the second power source ELVSS to the pixels PXL in the remaining period of the frame period 1F_1, e.g., during the second period P2, the third period P3, and the fourth period P4. On the other hand, the second power source driver 160 may supply the second power source ELVSS of the third voltage V3 to the pixels PXL during the black current prevention period Pb as in the second and third periods P2 and P3.

According to some exemplary embodiments, the first control line CL1 and the scan lines SL1 to SLn maintain the gate-off voltage during the black current prevention period Pb so that the second and third transistors M2 and M3 maintain a turned-off state. Thus, the first node N1 maintains the floating state.

When the first power source ELVDD of the first voltage V1 is supplied to the pixels PXL during the black current prevention period Pb, the voltage of the first node N1 falls due to the coupling of the first capacitor C1, and the first transistor M1 is turned on again. In this manner, the voltage of the third node N3, that is, the anode voltage of the organic light emitting diode OLED, is substantially initialized to the first voltage V1, and the voltage stored in the organic capacitor Coled is additionally discharged.

According to various exemplary embodiments, the organic capacitor Coled is additionally discharged immediately before the pixels PXL emit light, thereby effectively preventing a minute light emission phenomenon of the organic light emitting diode OLED that may be caused by leakage current at the black grayscale. Accordingly, it is possible to enhance the expressiveness of the black grayscale and improve the image quality of the organic light emitting display device OLED.

Figure 5:
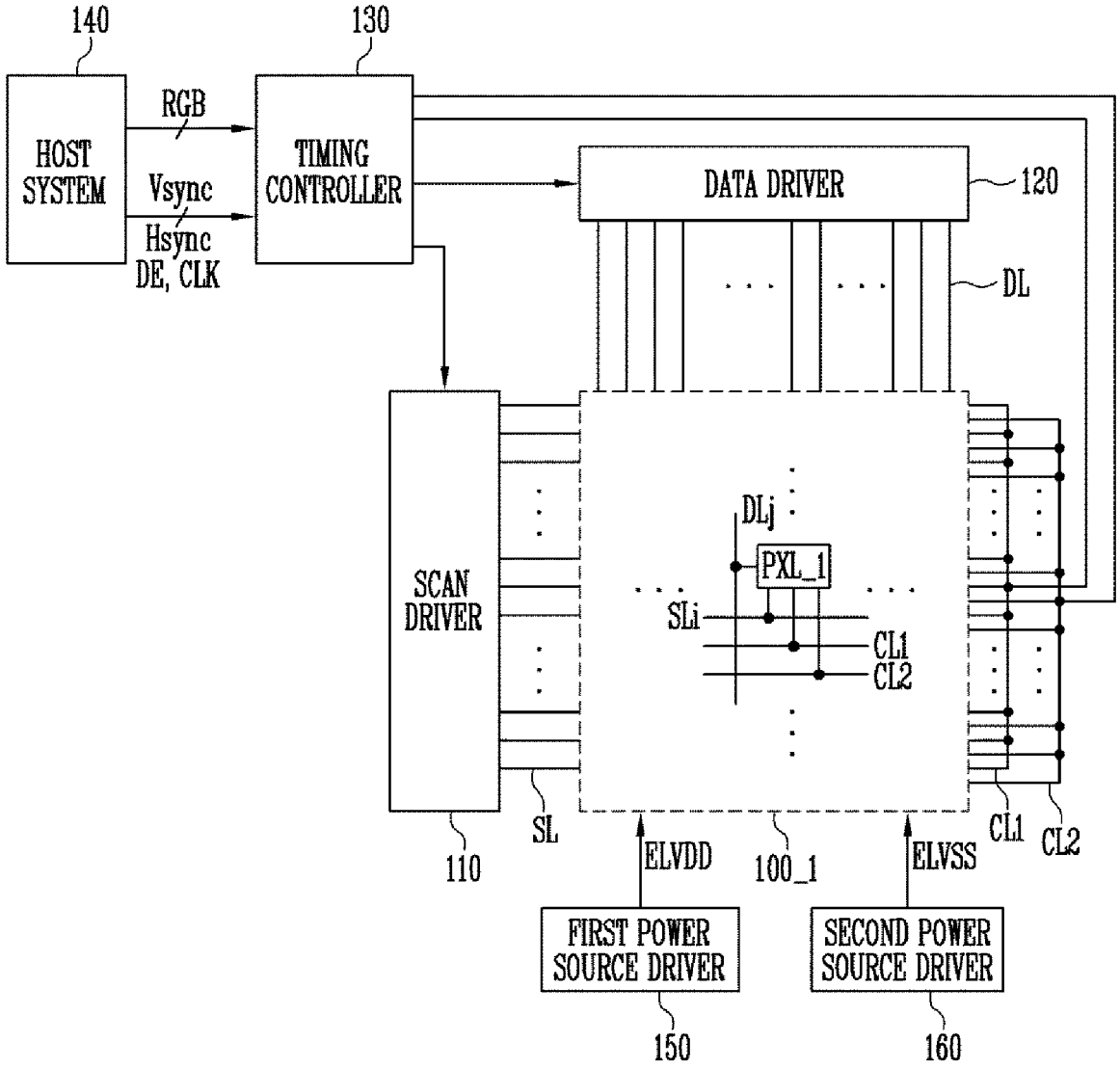
FIG. 5 is a diagram illustrating an organic light emitting display device according to some exemplary embodiments.
Figure 6:
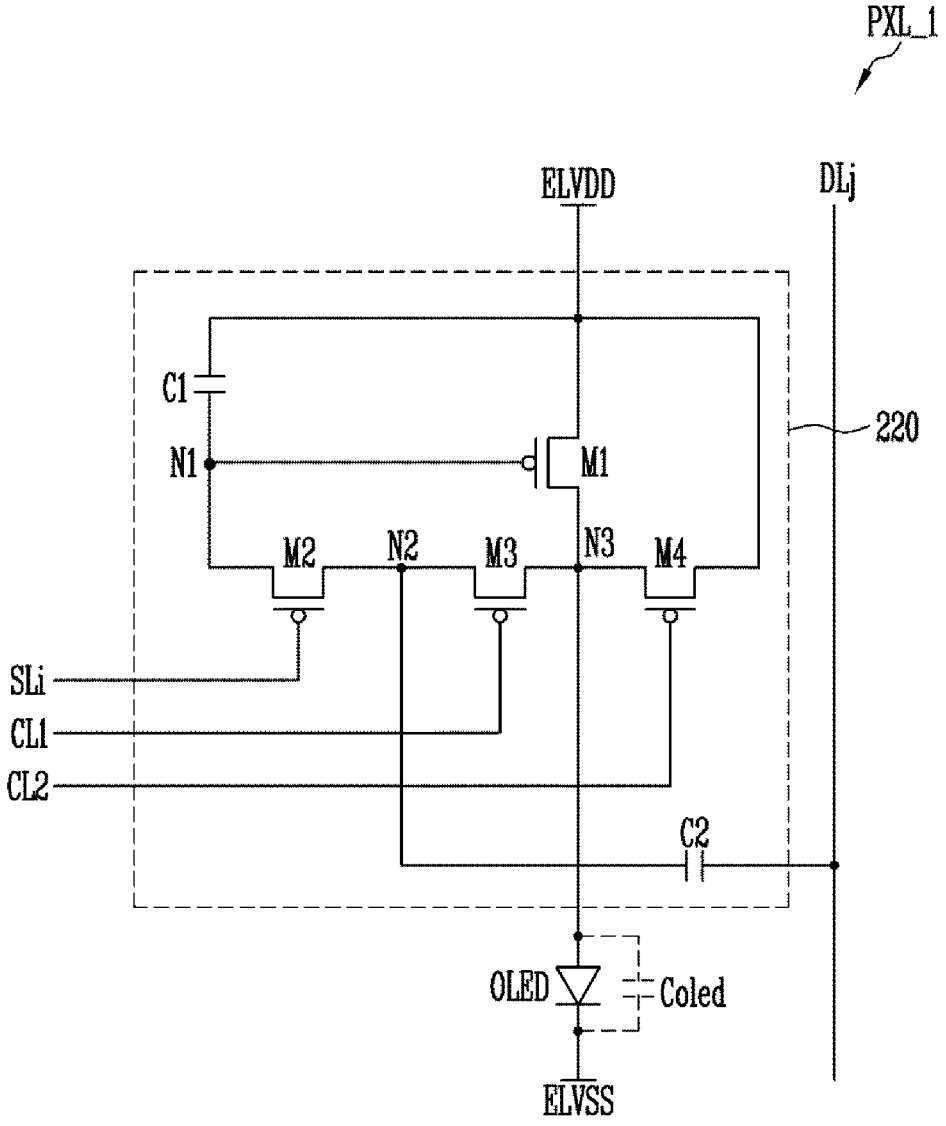
FIG. 6 is a diagram illustrating a pixel of the organic light emitting display device shown in FIG. 5 according to some exemplary embodiments.

FIG. 5 is a diagram illustrating an organic light emitting display device according to some exemplary embodiments. FIG. 6 is a diagram illustrating a pixel of the organic light emitting display device shown in FIG. 5 according to some exemplary embodiments. In FIGS. 5 and 6, the same or similar elements as those in FIGS. 1 and 2 are denoted by the same or similar reference numerals, and a detailed description thereof will be omitted.

Referring to FIG. 5, the organic light emitting display device may further include a second control line CL2 commonly connected to the pixels PXL_1. For example, the second control line CL2 is branched into a plurality of sub-lines in the pixel unit 100_1 so that the second control line CL2 is connected to the pixels PXL_1 of the respective horizontal lines, and all the sub-lines may be connected to each other as one. Therefore, the pixels PXL_1 may be simultaneously controlled using the second control signal supplied from the second control line CL2.

Also, the timing controller 130 may supply the second control signal to the second control line CL2. For example, the timing controller 130 may supply the second control signal to the second control line CL2 during a period in which the first power source ELVDD of the first voltage V1 is supplied to the pixels PXL_1. The second control signal is set to the gate-on voltage (for example, the low voltage), which allows transistors included in each of the pixels PXL_1 to be turned on. The timing controller 130 may maintain a voltage of the second control line CL2 at the gate-off voltage (for example, the high voltage) during the remaining period of one frame period, e.g., one frame period 1F or IF_1 (see FIGS. 7 and 8).

Referring to FIG. 6, each of the pixels PXL_1 may further include a fourth transistor M4. That is, the pixel circuit 220 of FIG. 6 further includes the fourth transistor M4 as compared with the pixel circuit 210 of FIG. 2. The fourth transistor M4 is connected between the first power source ELVDD and the third node N3, and a gate electrode of the fourth transistor M4 is connected to the second control line CL2. The fourth transistor M4 is turned on when the second control signal is supplied to the second control line CL2, and the fourth transistor M4 electrically connects the first power source ELVDD and the third node N3.

According to various exemplary embodiments, the first voltage V1 may be stably supplied to the third node N3 of each of the pixels PXL during the period that the first power source ELVDD of the first voltage V1 is supplied to the pixels PXL. Thus, the third node N3 of each of the pixels PXL may be uniformly initialized during the first period P1 and/or the black current prevention period Pb.

Figure 7:
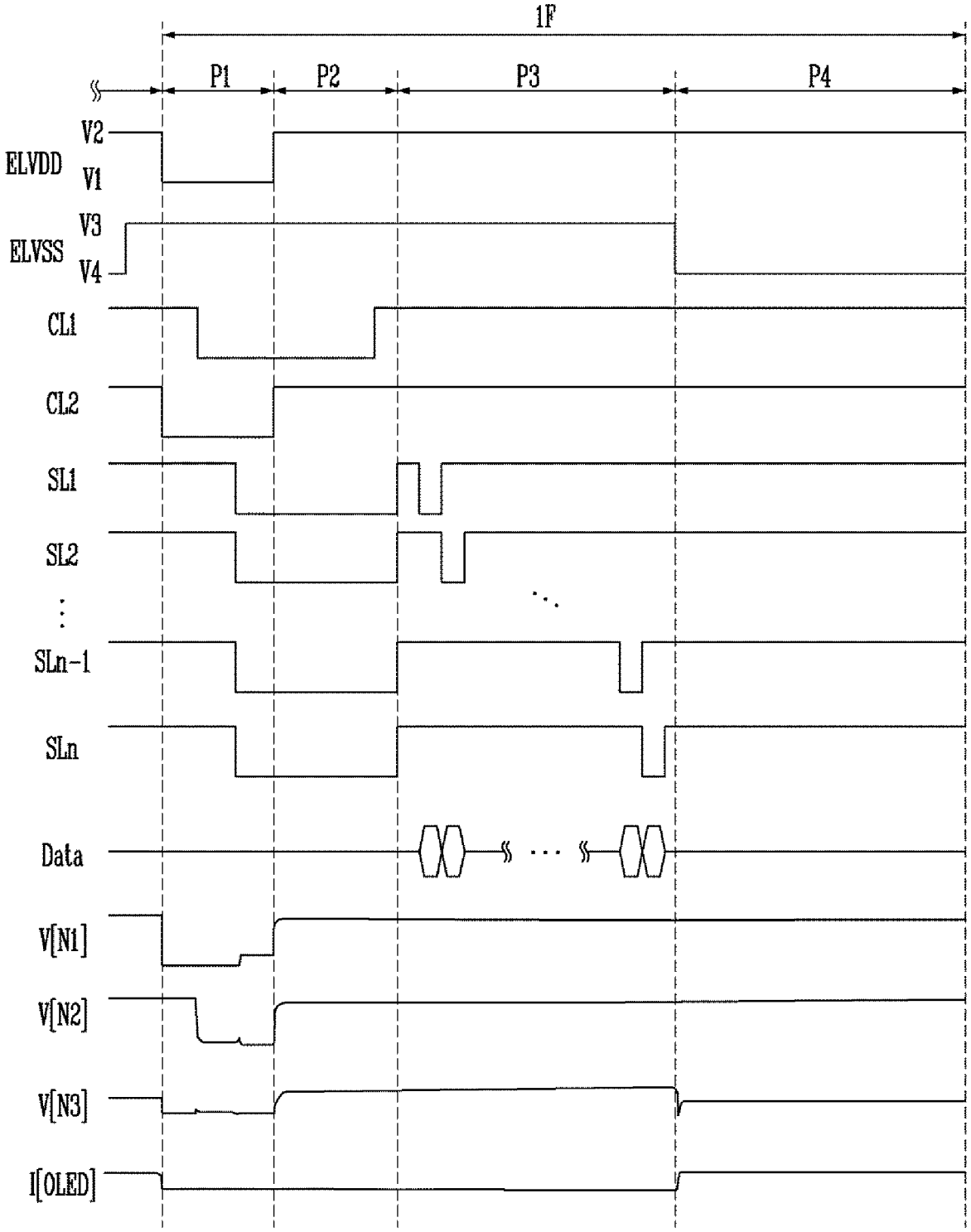
FIG. 7 is a diagram illustrating a driving method of the pixel shown in FIG. 6 according to some exemplary embodiments.
Figure 8:
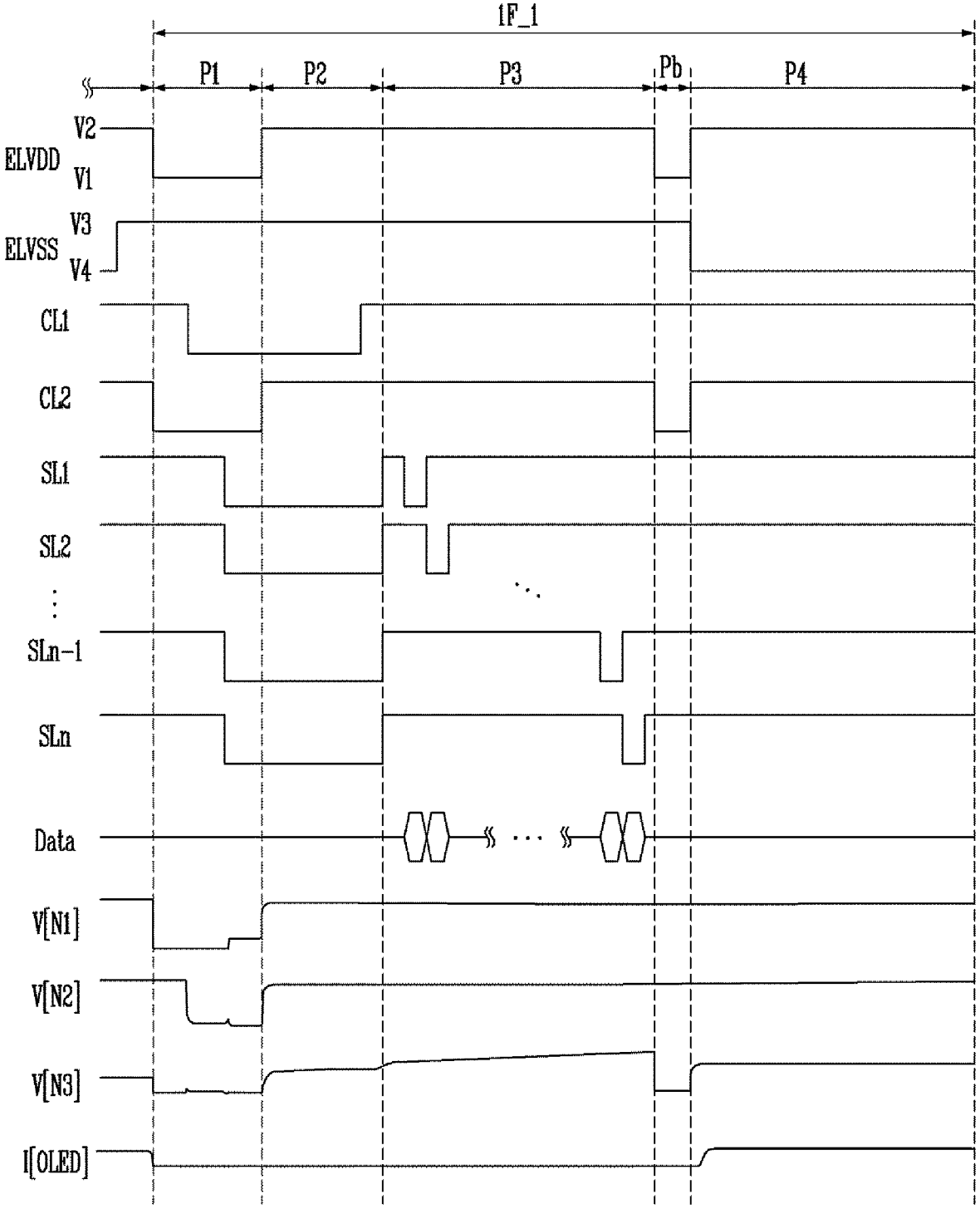
FIG. 8 is a diagram illustrating a driving method of the pixel shown in FIG. 6 according to some exemplary embodiments.

FIG. 7 is a diagram illustrating a driving method of the pixel shown in FIG. 6 according to some exemplary embodiments. FIG. 8 is a diagram illustrating a driving method of the pixel shown in FIG. 6 according to some exemplary embodiments. In FIGS. 7 and 8, detailed descriptions of operations similar to or the same as those in FIGS. 3 and 4 are omitted.

Referring to FIGS. 7 and 8, the timing controller 130 may supply the second control signal to the second control line CL2 during a period in which the first power source ELVDD of the first voltage V1 is supplied to the pixels PXL_1, and may maintain the voltage of the second control line CL2 at the gate-off voltage for the remaining period. For example, as shown in FIG. 7, the first power source driver 150 may supply the first power source ELVDD of the first voltage V1 to the pixels PXL_1 during the first period P1, and the timing controller 130 may supply the second control signal to the second control line CL2 during the first period P1. Furthermore, the first power source driver 150 may supply the first power source ELVDD of the second voltage V2 during the remaining periods except for the first period P1, for example, during the second period P2, the third period P3, and the fourth period P4. The timing controller 130 may maintain the voltage of the second control line CL2 at the gate-off voltage during the second period P2, the third period P3, and the fourth period P4.

As shown in FIG. 8, one frame period 1F_1 may further include the black current prevention period Pb that is inserted immediately before the emission period (for example, between the third period P3 and the fourth period P4). The first power source driver 150 may simultaneously supply the first power source ELVDD of the first voltage V1 to the pixels PXL_1 during the first period P1 and the black current prevention period Pb, and the timing controller 130 may simultaneously supply the second control signal to the second control line CL2 during the first period P1 and the black current prevention period Pb. In addition, the first power source driver 150 may supply the first power source ELVDD of the second voltage V2 to the pixels PXL_1 during the remaining periods except the first period P1 and the black current prevention period Pb, that is during the second period P2, the third period P3, and the fourth period P4. The timing controller 130 may maintain the voltage of the second control line CL2 at the gate-off voltage during the second period P2, the third period P3, and the fourth period P4.

As previously described, the timing controller 130 directly supplies the first and/or second control signals to the pixels PXL or PXL_1 through the first and/or second control lines CL1 and/or CL2, but exemplary embodiments are not limited thereto. For example, in some exemplary embodiments, a separate control line driver for driving the first and/or second control lines CL1 and/or CL2 may be additionally provided, and the control line driver may supply the first and/or second control signals to the first and/or second control lines CL1 and CL2, corresponding to the control of the timing controller 130.

According to various exemplary embodiments, the first voltage V1 may be stably supplied to the third node N3 of each of the pixels PXL during the period when the first power source ELVDD of the first voltage V1 is supplied to the pixels PXL or PXL_1. Therefore, during the remaining period except for the light emission period (for example, at least one period of the fourth period P4) in which the pixels PXL or PXL_1 are set to emit light, it is possible to prevent the voltage of the third node N3 from rising even if the second power source ELVSS of the third voltage V3 (e.g., the high voltage) is supplied to the pixels PXL or PXL_1.

For example, in the organic light emitting display device as described in association with FIGS. 5 to 8, the second power source driver 160 may supply the second power source ELVSS of the fourth voltage V4 (e.g., the low voltage) to the pixels PXL_1 during the actual light emission period (e.g., at least one period of the fourth period P4) of the pixels PXL_1, and the second power source driver 160 may supply the second power source ELVSS of the third voltage V3 to the pixels PXL_1 during the remaining period (e.g., at least the first to third periods P1 to P3), except for the actual light emission period.

As described in association with FIGS. 7 and 8, the remaining operation processes of the pixels PXL_1 may be substantially the same as those described in association with FIGS. 3 and 4, respectively. Therefore, a detailed description thereof will be omitted.

According to various exemplary embodiments, an organic light emitting display device includes pixels having a simple structure and is capable of emitting light with a uniform luminance irrespective of a threshold voltage of a driving transistor and a voltage drop of a first power source, and a driving method thereof. According to some exemplary embodiments, it is possible to provide an organic light emitting display device applicable to a high-resolution panel and capable of displaying images of uniform image quality, and a driving method thereof.

Although certain exemplary embodiments and implementations have been described herein, other embodiments and modifications will be apparent from this description. Accordingly, the inventive concepts are not limited to such embodiments, but rather to the broader scope of the accompanying claims and various obvious modifications and equivalent arrangements as would be apparent to one of ordinary skill in the art.

What is claimed is:

1. An organic light emitting display device comprising:

pixels connected to scan lines, data lines, and a first control line;

a first power source driver configured to supply a first power source to the pixels; and a second power source driver configured to supply a second power source to the pixels, wherein the organic light emitting display device is configured to drive the pixels in a frame period, the frame period comprising at least a first period, a second period, a third period, and a fourth period, wherein each of the pixels comprises:

an organic light emitting diode connected between the first power source and the second power source;

a first transistor connected between the first power source and the organic light emitting diode, a gate electrode of the first transistor being connected to a first node;

a second transistor connected between the first node and a second node, a gate electrode of the second transistor being connected to a corresponding scan line among the scan lines;

a third transistor connected between the second node and a third node, the third node being connected between the first transistor and the organic light emitting diode, a gate electrode of the third transistor being connected to the first control line;

a first capacitor connected between the first power source and the first node; and a second capacitor connected between the second node and a corresponding data line among the data lines, wherein the pixels are commonly connected to the first control line;

wherein the first power source driver is configured to supply the first power source of a first voltage less than or equal to a voltage of the second power source to the pixels during the first period; and wherein the first power source driver is configured to supply the first power source of a second voltage greater than or equal to the voltage of the second power source to the pixels during the second period, the third period, and the fourth period.

2. The organic light emitting display device of claim 1, wherein the pixels are simultaneously driven during the first period, the second period, and the fourth period, and wherein the pixels are sequentially driven in units of horizontal lines during the third period.

3. The organic light emitting display device of claim 1, further comprising:

a scan driver configured to supply scan signals to the scan lines;

a data driver configured to supply data signals to the data lines; and a timing controller configured to control the scan driver, the data driver, the first power source driver, and the second power source driver, the timing controller being configured to supply a first control signal to the first control line.

4. The organic light emitting display device of claim 3, wherein the frame period further comprises a black current prevention period between the third period and the fourth period.

5. The organic light emitting display device of claim 3, wherein the timing controller is configured to supply the first control signal of a gate-on voltage to the first control line from a determined time in the first period to a determined time in the second period.

6. The organic light emitting display device of claim 5, wherein the scan driver is configured to simultaneously supply scan signals of a gate-on voltage to the scan lines from a determined time in the first period to a determined time in the second period, and wherein the scan driver is configured to sequentially supply the scan signals of the gate-on voltage to the scan lines during the third period.

7. The organic light emitting display device of claim 6, wherein, during the first period and the second period, the scan driver is configured to:

start a supply of the scan signals after starting a supply of the first control signal; and stop the supply of the scan signals after stopping the supply of the first control signal.

8. The organic light emitting display device of claim 6, wherein the frame period comprises:

a first duration from a determined time in the first period in which the scan signals and the first control signal are supplied through the third period, and a second duration corresponding to a remaining portion of the frame period other than the first duration, wherein the second power source driver is configured to supply the second power source of a third voltage greater than or equal to a voltage of the first power source during the first duration of the frame period, and wherein the second power source driver is configured to supply the second power source of a fourth voltage less than or equal to the voltage of the first power source during the second duration of the frame period.

9. An organic light emitting display device comprising:

pixels connected to scan lines, data lines, a first control line, and a second control line, wherein the organic light emitting display device is configured to drive the pixels in a frame period, the frame period comprising at least a first period, a second period, a third period, and a fourth period, wherein each of the pixels comprises:

an organic light emitting diode connected between a first power source and a second power source;

a first transistor connected between the first power source and the organic light emitting diode, a gate electrode of the first transistor being connected to a first node;

a second transistor connected between the first node and a second node, a gate electrode of the second transistor being connected to a corresponding scan line among the scan lines;

a third transistor connected between the second node and a third node, the third node being connected between the first transistor and the organic light emitting diode, a gate electrode of the third transistor being connected to the first control line;

a fourth transistor connected between the first power source and the third node, a gate electrode of the fourth transistor being connected to the second control line;

a first capacitor connected between the first power source and the first node; and a second capacitor connected between the second node and a corresponding data line among the data lines, wherein the pixels are commonly connected to the first control line and the second control line.

10. The organic light emitting display device of claim 9, further comprising:

a scan driver configured to supply scan signals to the scan lines;

a data driver configured to supply data signals to the data lines;

a first power source driver configured to supply the first power source to the pixels;

a second power source driver configured to supply the second power source to the pixels; and a timing controller configured to control the scan driver, the data driver, the first power source driver, and the second power source driver, the timing controller being configured to supply a first control signal to the first control line, wherein the pixels are simultaneously driven during the first period, the second period, and the fourth period, wherein the pixels are sequentially driven in units of horizontal lines during the third period, wherein the first power source driver is configured to supply the first power source of a first voltage less than or equal to a voltage of the second power source during the first period, and wherein the organic light emitting display device is configured to supply a second control signal of a gate-on voltage to the second control line during the first period.

11. The organic light emitting display device of claim 10, wherein the second power source driver is configured to supply the second power source of a third voltage greater than or equal to a voltage of the first power source during the second period and the third period, and wherein the second power source driver is configured to supply the second power source of a fourth voltage less than or equal to the voltage of the first power source during at least a portion of the fourth period.

12. The organic light emitting display device of claim 10, wherein the first power source driver is configured to supply the first power source of a second voltage greater than or equal to the voltage of the second power source during the second period, the third period, and the fourth period, and wherein the organic light emitting display device is configured to maintain a voltage of the second control line at a gate-off voltage during the second period, the third period, and the fourth period.

13. The organic light emitting display device of claim 12, wherein the frame period further comprises a black current prevention period between the third period and the fourth period.

14. The organic light emitting display device of claim 13, wherein the first power source driver is configured to supply the first power source of the first voltage during the black current prevention period, and wherein the organic light emitting display device is configured to supply the second control signal of the gate-on voltage to the second control line during the black current prevention period.

15. A method of driving an organic light emitting display device during a frame period, the organic light emitting display device comprising pixels, the frame period comprising a first period, a second period, a third period, and a fourth period, the method comprising:

initializing an anode voltage of each organic light emitting diode of the pixels to a first voltage while supplying a first power source of the first voltage to the pixels during the first period;

initializing first nodes to the first voltage during at least a portion of the first period, the first nodes being respectively connected to gate electrodes of corresponding driving transistors of the pixels;

storing voltages corresponding to threshold voltages of the driving transistors in respective first capacitors of the pixels while supplying the first power source of a second voltage greater than the first voltage during the second period;

storing one or more voltages corresponding to a data signal in the respective first capacitors of the pixels while sequentially supplying scan signals to scan lines connected to the pixels during the third period; and allowing the pixels to emit light corresponding to the data signal during the fourth period.

16. The driving method of claim 15, wherein the pixels are simultaneously driven during the first period, the second period, and the fourth period, and wherein the pixels are sequentially driven in units of horizontal lines during the third period.

17. The driving method of claim 15, wherein a second power source of a third voltage greater than or equal to a voltage of the first power source is supplied to the pixels at least during the second period and the third period, and wherein the second power source of a fourth voltage less than or equal to the voltage of the first power source is supplied to the pixels during at least a portion of the fourth period.

18. The driving method of claim 15, wherein the frame period further comprises a black current prevention period between the third period and the fourth period, and wherein the method further comprises:

initializing an anode voltage of each organic light emitting diode of the pixels to the first voltage while simultaneously supplying the first power source of the first voltage to the pixels during the black current prevention period.

* * * * *